United States Patent [19]

Hasegawa et al.

[11] Patent Number: 4,563,874

[45] Date of Patent: Jan. 14, 1986

[54] DRIVING GEAR OF ROTOR TYPE OPEN END FINE SPINNING MACHINE

[75] Inventors: Junzo Hasegawa; Susumu Kawabata; Nobuharu Mimura; Masao Kitano, all of Aichi, Japan

[73] Assignee: Kabushiki Kaisha Toyota Chuo Kenkyusho, Japan

[21] Appl. No.: 543,512

[22] Filed: Oct. 18, 1983

[30] Foreign Application Priority Data

Nov. 1, 1982 [JP] Japan ..... 57-193060

[51] Int. Cl.[4] ..... D01H 1/12; D01H 7/882

[52] U.S. Cl. ..... 57/406

[58] Field of Search ..... 57/400, 404, 406, 92, 57/102

[56] References Cited

U.S. PATENT DOCUMENTS

| | | | |
|---|---|---|---|
| 3,911,659 | 10/1975 | Mandl | 57/406 |
| 3,918,248 | 11/1975 | Suzuki | 57/407 X |
| 3,927,516 | 12/1975 | Stahlecker | 57/102 X |
| 3,958,846 | 5/1976 | Donner | 57/406 X |

FOREIGN PATENT DOCUMENTS

| | | |
|---|---|---|
| 2023511 | of 0000 | Fed. Rep. of Germany . |
| 2714299 | of 0000 | Fed. Rep. of Germany . |
| 2114987 | of 0000 | France . |
| 1419586 | of 0000 | United Kingdom . |
| 1546434 | of 0000 | United Kingdom . |

*Primary Examiner*—Donald Watkins

*Attorney, Agent, or Firm*—Mason, Fenwick & Lawrence

[57] ABSTRACT

In a driving gear of a rotor type open end fine spinning machine, a rotation shaft of a spinning rotor and a drive shaft are connected through a speed multiplying mechanism, the spinning rotor facing to a fiber feed passage and a yarn taking passage is rotated at a multiplied speed by rotation driving of the drive shaft, a cover is installed to surround the spinning rotor and the rotation shaft thereof, an air passage is constituted so that air flow to guide fibers at the fiber feed passage into the spinning rotor passes through inside of the cover and is exhausted out of an exhaust port provided on the cover, and air flow passing through the air passage eliminates the friction heat caused by rotation of the spinning rotor.

6 Claims, 7 Drawing Figures

DRIVING GEAR OF ROTOR TYPE OPEN END FINE SPINNING MACHINE

BACKGROUND OF THE INVENTION

The present invention relates to a driving gear for a rotor type, open end fine spinning machine, in which a spinning rotor is rotated at a high speed and friction heat produced by the rotation of the spinning rotor is removed.

A rotor type, open end spinning machine in the prior art has a driving gear in which a rotation shaft of a spinning rotor is connected to a motor by a belt transmission mechanism. Such a spinning rotor is rotated at a high speed greater than 40,000 r.p.m., since productivity of yarn is proportional to the rotational speed of the spinning rotor. When the spinning rotor is rotated at a high speed, however, the driving force for the spinning rotor increases because of weight of the spinning rotor itself, and the rotation load caused by air resistance increases the tension imposed on the belt of the transmission mechanism. In the above-mentioned driving gear, tension or vibration of the belt is transmitted directly to the rotation shaft of the spinning rotor, whereby the rotation shaft of the spinning rotor and a bearing thereof may be abraded severely and the rotational speed of the spinning rotor is limited thereby.

Another driving gear has been invented in which a number of small motors is coupled to corresponding ones of a like number of spinning rotors. However, such a driving gear requires a large number of the small motors, e.g. 100 to 200, to be coupled to a like number of the spinning rotors and therefore becomes expensive.

Another driving gear has been invented in which a disc roller is interposed between the rotation shaft of the spinning rotor and the belt connected to the motor. In such a driving gear, a space is required for the disc roller and the spacings between the spinning rotors are widened, whereby the spinning rotors which can be installed on the fine spinning machine are decreased in number and it is difficult to improve the productivity of one spinning machine.

In order to eliminate above-mentioned disadvantages in the prior art, the inventors have already invented a driving gear as set forth in U.S. patent application Ser. No. 413,547. In this driving gear, a drive shaft connected to a motor by a belt transmission mechanism and a rotation shaft of a spinning rotor are coupled through a speed multiplying mechanism comprised of a small planetary friction wheel mechanism so that the spinning rotor is rotated at a high speed with little vibration. However, as the rotational speed of the spinning rotor is increased, the amount of lubrication oil to be supplied to the speed multiplying mechanism must be increased, and the heat generation due to friction in the bearing of the rotation shaft of the spinning rotor and the speed multiplying mechanism, increases. Accordingly, the rotational speed of the spinning rotor is limited by the heat generation due to friction and increased productivity is also limited.

SUMMARY OF THE INVENTION

It is an object of the invention to provide a driving gear for a rotor type, open end fine spinning machine wherein productivity of yarn is increased.

It is another object of the invention to provide a driving gear of a rotor type, open end fine spinning machine wherein a spinning rotor is rotated at a high speed and friction heat produced by the rotation is eliminated.

In order to attain above-mentioned objects, the inventors have noticed that a rotor type, open end fine spinning machine utilizes air flow to feed fibers as raw material into a spinning rotor and propose to utilize the fiber feeding air flow also to eliminate the friction heat caused by rotation of the spinning rotor. That is, the present invention is in a driving gear of a rotor type, open end fine spinning machine, in which a rotation shaft of a spinning rotor and a drive shaft are connected through a speed multiplying mechanism, the spinning rotor facing a fiber feed passage and a yarn receiving passage can be rotated at a multiplied speed by rotation driving of the drive shaft. A cover surrounds the spinning rotor of the rotation shaft. The cover defines an air passage so that an air flow to guide fibers at the feed passage is also directed into the spinning rotor, before flowing out of an exhaust port provided on the cover. The air flow eliminates the friction heat caused by rotation of the spinning rotor.

In the driving gear of the present invention, the friction heat caused by rotation of the spinning rotor, for example, the friction heat in a bearing of the rotation shaft of the spinning rotor or the speed multiplying mechanism, can be eliminated by air flow. Therefore, the rotational speed of the spinning rotor can be increased in comparison to conventional driving gears with speed multiplying mechanism, which do not have a cooling device. Accordingly, productivity can be improved in the present invention. Furthermore, air flow to eliminate the friction heat caused by rotation of the spinning rotor, is the air flow to the guide fibers at the fiber feed passage into the spinning rotor, and the cooling and the fiber feeding are performed by one air flow. Therefore, the necessity of providing power only to generate the cooling air flow is obviated, and the structure is simplified in comparison to the case of using individual air flow for both the cooling and the fiber feeding.

DETAILED DESCRIPTION OF THE PREFERRED EMBODIMENTS

Figure 1:
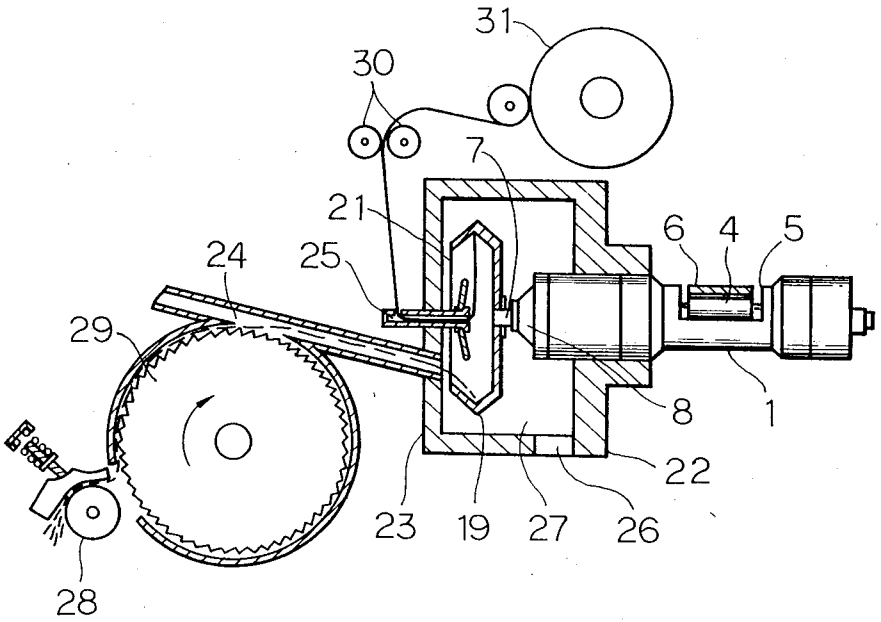
FIG. 1 is a longitudinal section view of part of a rotor type type open end fine spinning machine, showing a driving gear in accordance with a first embodiment of the invention.

A first, illustrative embodiment will be described with respect to FIGS. 1 to 5. A rotor type, open end fine spinning machine with a driving mechanism gear, comprises a cylindrical casing 1, a drive shaft 2 installed in the casing 1, and roller bearings 3 fitted to the inside of the casing 1. The drive shaft 2 has both of its ends supported through the roller bearings 3 and, therefore, it is rotatably supported to the casing 1 in coaxial relation. A pulley 4 is fitted to a center portion of the drive shaft 2 and faces a window 5 within the circumferential wall of the casing 1. A belt 6 connected to a motor (not shown), is coupled to the pulley 4 to rotationally drive the drive shaft 2. Also in the casing 1 as shown in FIG. 2, a rotation shaft 7 has a top end portion extending through an end plate 8 at the top end of the casing 1, a center portion supported by a roller bearing 9 fitted inside of the casing 1, and a base end portion rotatably supported by the end side of the drive shaft 7, in coaxial rotation thereto. As clearly seen in FIG. 2 and FIG. 3, a radial groove 10 is formed on an outer circumferential surface at the base end portion of the rotation shaft 7. A support ring 11 is connected to the top end portion of the drive shaft 2 on the outside of the radial groove 10. A stationary ring 12 is fitted to the inside of the casing 1 at the outside of the support ring 11 of the drive shaft 7. Planetary friction wheels 14, each comprising a cylindrical rotor, are slidably fitted within recesses 13, which are arranged at regular intervals about the support ring 11 of the drive shaft 2 along the axial direction. Each of the planetary friction wheels 14 has a diameter larger than the thickness of the support ring 11, which are fitted under suitable pressure between the inner circumferential surface of the stationary ring 12 and the radial groove 10 of the rotation shaft 7. When the drive shaft 2 is rotated, the planetary friction wheels 14 are rotated around the rotation shaft 7 and, at the same time, each wheel 14 is rotated on its own axis. Thereby, the rotation shaft 7 is rotated at multiplied speed. The speed multiplying mechanism comprises the planetary friction wheel mechanism.

Figure 2:
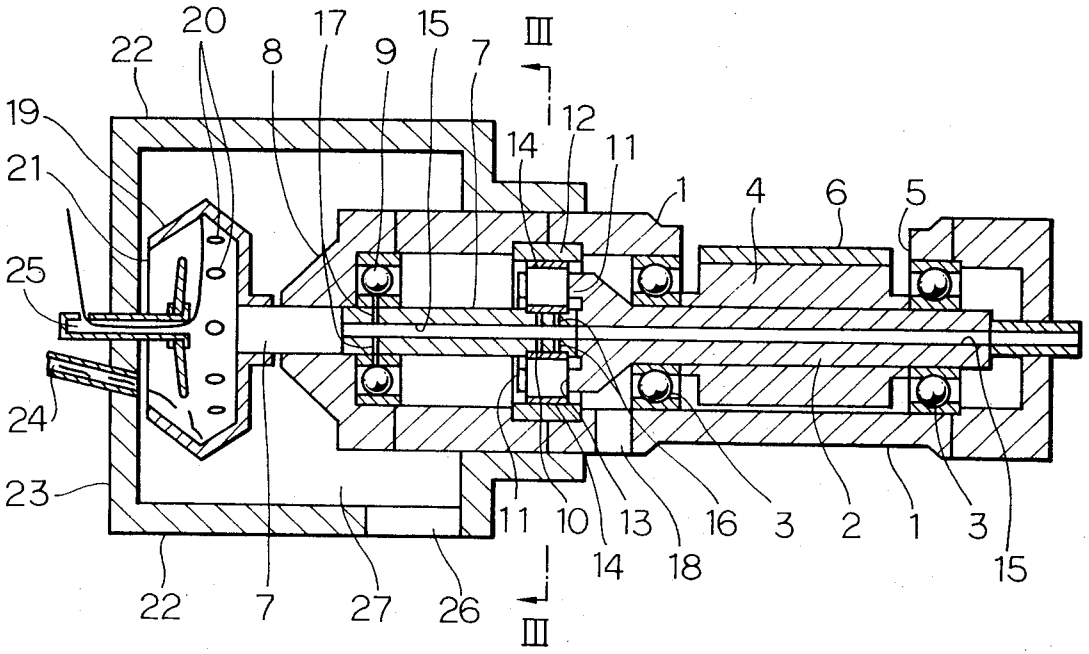
FIG. 2 is an enlarged, longitudinal section view of part of the fine spinning machine shown in FIG. 1.
Figure 3:
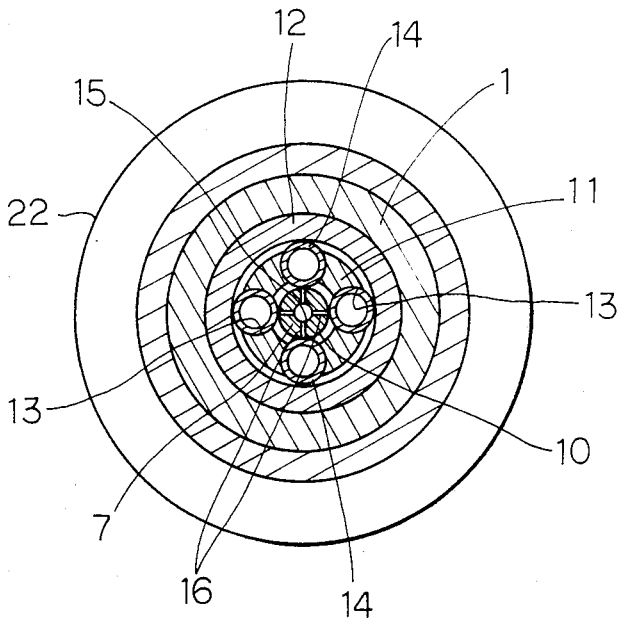
FIG. 3 is a sectional view taken along line III—III of FIG. 2.
Figure 4:
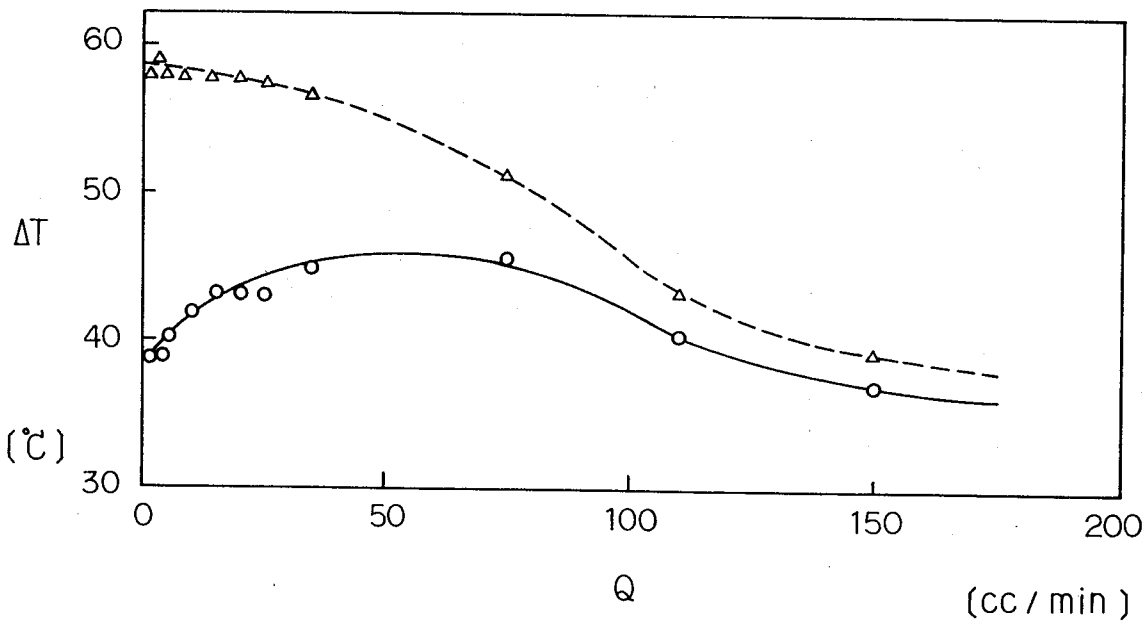
FIG. 4 is a diagram showing the relation between bearing temperature rise and the amount of lubrication oil flow in the fine spinning machine.

The drive shaft 2 and the rotation shaft 7 are arranged coaxially, as shown in FIG. 2 and FIG. 3, and are provided with an oil feed passage 15 at their axial center. A plurality of oil feed passages 16 extend from the oil feed passage 15 to the radial groove 10 of the rotation shaft 7. Also, a plurality of oil feed passages 17 extend radially from the oil feed passage 15 to the inside of an inner race of the roller bearings 9. Lubrication oil is supplied from an oil feed source (not shown) the oil feed passage 15 to the base end surface of the drive shaft 2, through the oil feed passages 16 to the speed multiplying mechanism 10, 11, 12, 13, 14 and through the oil feed passages 17 to the roller bearings 9. Lubrication oil flows respectively out of the speed multiplying mechanism 10, 11, 12, 13, 14 and the roller bearings 9 and is returned through an oil exhaust hole 18 disposed through the circumferential wall of the casing 1 to the oil feed source.

A spinning rotor 19 of cup-like shape is disposed coaxially of and attached to the top end of the rotation shaft, which projects from the end plate 8 at the top end of the casing 1, as shown in FIGS. 1 and 2. Air exhaust holes 20 are arranged at regular intervals about and are disposed through that portion of the circumferential wall of the spinning rotor 19 having the maximum inner diameter. When the spinning rotor 19 is rotated, air flow is generated in the spinning rotor 19 to enter through an opening 21 and exit through the air exhaust holes 20.

The spinning rotor 19 and the top end of the casing 1, as shown in FIGS. 1 and 2, are surrounded by a cover 22 of cylindrical configuration and are made of a material having high thermal conductivity and heat radiation, such as aluminum. An end plate 23 disposed at top end of the cover 22 faces toward the opening 21 of the spinning rotor. An opened base end of the cover 22 is fitted to the top end of the casing 1. The cover 22 surrounds the spinning rotor 19 and the rotation shaft 7 thereof is disposed coaxially with respect to the casing 1. A tube has a fiber feed passage 24 disposed through the end plate 23 of the cover 22. The fiber feed passage 24 faces towards a peripheral portion of the opening 21 of the spinning rotor 19. A tube provides a yarn receiving passage 25 is disposed through the end plate 23 of the cover 22. The yarn receiving passage 25 faces towards a center portion of the spinning rotor 19. An air passage 27 is formed by the cover 22 so that the air flow as generated by rotation of the spinning rotor 19, passes through the fiber feed passage 24, the inside of the spinning rotor 19, the opening 21, the air exhaust holes 20, and the inside of the cover 22 to be discharged through an exhaust port 26 disposed through the circumferential wall of the cover 22. The air flow passing through the air passage 27 eliminates the friction heat produced during rotation of the spinning rotor 19. In FIG. 1, reference numeral 28 designates a sliver feed device, and numeral 29 designates a sliver opener to feed fibers from the silver feed device 28 into the fiber feed passage 24. Numeral 30 designates a yarn winder and numeral 31 a cheese.

In order to use a rotor type open end fine spinning machine with the driving gear of this embodiment, lubrication oil is supplied to the oil feed passage 15. The drive shaft 2 rotates the spinning rotor 19 at an increased or multiplied speed compared to that of the drive shaft 2. Fibers in the fiber feed passage 24 are fed through the opening 21 and into the spinning rotor 19 during its rotation by help of the air flow generated by the rotation of the spinning rotor 19. The fibers are pressed toward the maximum inner diameter portion of the spinning rotor 19 and then collected into a fiber bundle. A strand of the yarn is withdrawn from the fiber bundle and taken out of the spinning rotor 19 at a speed much slower than peripheral speed of the maximum inner diameter portion of the spinning rotor 19. The fiber bundle connected to the strand is separated from inner surface of the spinning rotor 19 during rotation and twisted into the strand. The strand is taken through the yarn receiving passage 25 and then wound. Air flow generated by the rotation of the spinning rotor 19 passes through the air passage 27 and is exhausted out of the exhaust port 26. When air flow passes through the air passage 27, it eliminates the friction heat produced at the roller bearing 9 of the rotation shaft and the speed multiplying mechanism 10, 11, 12, 13, 14 of the planetary friction wheel mechanism.

Figure 5:
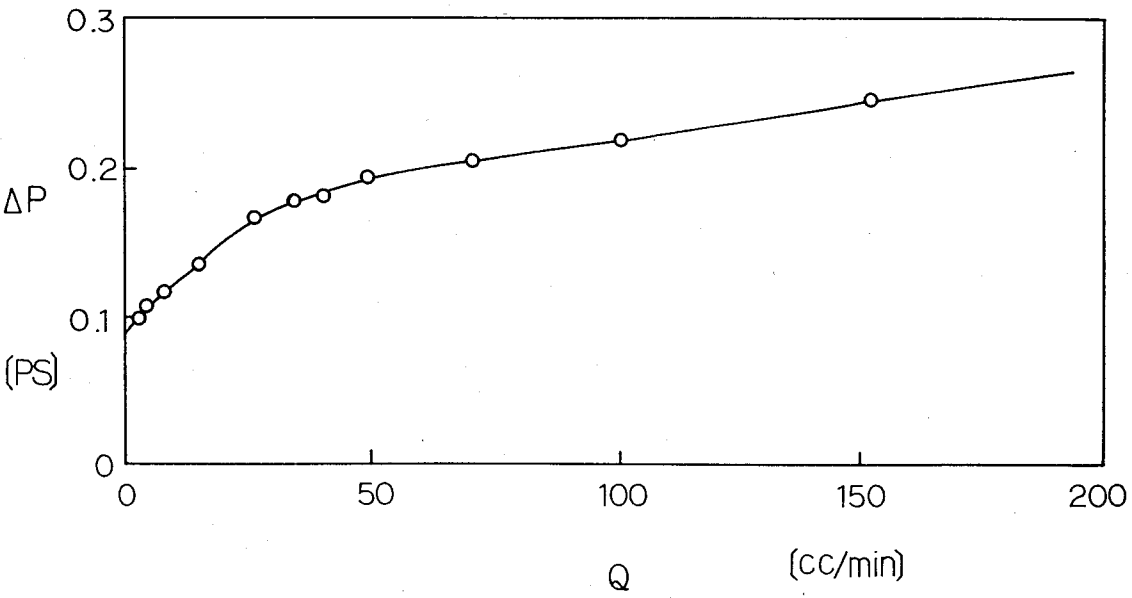
FIG. 5 is a diagram showing the relation between power loss and the amount of lubrication oil flow in the fine spinning machine.

In order to confirm the heat eliminating effect of the driving gear of this embodiment, the flow amount Q of lubrication oil was set to various values. The spinning rotor 19 was rotated at 60,000 r.p.m. and temperature rise $\Delta T$ at outer race of the roller bearing 9 of the rotation shaft was measured for various values of Q. The test results are shown by the solid line passing through the circular marks in diagram of FIG. 4. Next, in comparison to this result, the cover 22 and the spinning rotor 19 was removed. The rotation shaft 7 was rotated at 60,000 r.p.m. and the temperature rise ΔT at outer race of the roller bearing 9 of the rotation shaft was measured for various values of Q to yield the test results as shown by the broken line passing through the triangular marks in FIG. 4. It is clear from diagram of FIG. 4 that use of the driving gear of this embodiment in the rotor type, open end fine spinning machine with driving gear reduces the friction and, thus, the temperature rise at the roller bearing 9 of the rotation shaft 7, assuming that the same amount of lubrication oil is used. In other words, if allowable temperature rise of the roller bearing 9 is the same, the needed amount of lubrication oil may be decreased. FIG. 5 illustrates the relation between the amount of Q of the lubrication oil flow and the power loss ΔP, when the spinning rotor 19 is rotated at 80,000 r.p.m. If the flow amount of lubrication oil is decreased, the power loss caused by stirring the lubrication oil is decreased. As a result, if the lubrication oil flow amount and allowable temperature rise of the roller bearing 9 have the same values respectively, the rotational speed of the spinning rotor 19 can be increased and the productivity be improved.

Figure 6:
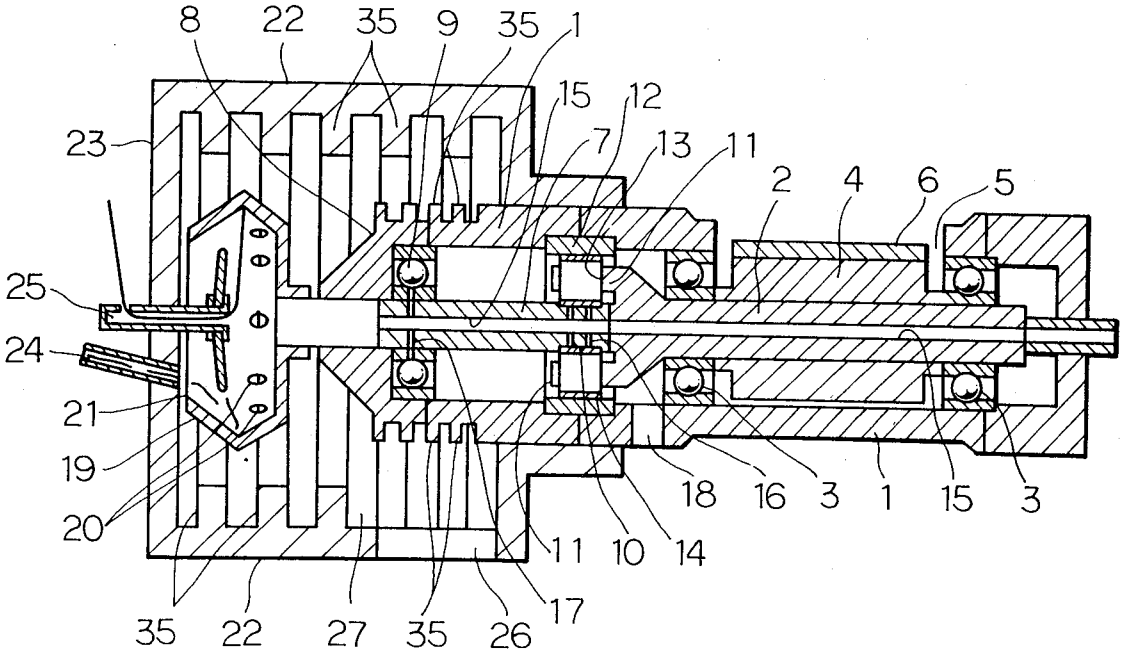
FIG. 6 is a longitudinal, section view of part of a rotor type, open end fine spinning machine, showing a driving gear in accordance with a second embodiment of the invention.

In a second embodiment of the driving gear of this invention as shown in FIG. 6, the inner circumferential surface of the cover 22 of cylindrical configuration and the outer circumferential surface of the top end portion of the cylindrical casing 1 projecting inside of the cover 22, are respectively provided with a large number of radiation fins 35 arranged in parallel with each other. The radiation fins 35 project into the air passage 27 between the cover 22 and top end portion of the casing 1. Since this embodiment is similar to the first embodiment except for the above-mentioned constitution, like parts of the second embodiment shown in FIG. 6 are designated respectively by the same reference numerals as were used in their first embodiment and the description will be omitted.

In the driving gear of this embodiment, the fins 35 are added to the top end portion of the casing 1 and the cover 22, which are subjected to the friction heat produced by the roller bearing 9 and/or by the speed multiplying mechanism 10, 11, 12, 13, 14, to increase the heat radiation area. The air flow passing through the air passage 27 is made turbulent by the radiation fins 35 projecting there. As a result, heat transfer from the top end portion of the casing 1 and the cover 22 to the air flow through the air passage 27, is improved, whereby the cooling effect is further enhanced.

Figure 7:
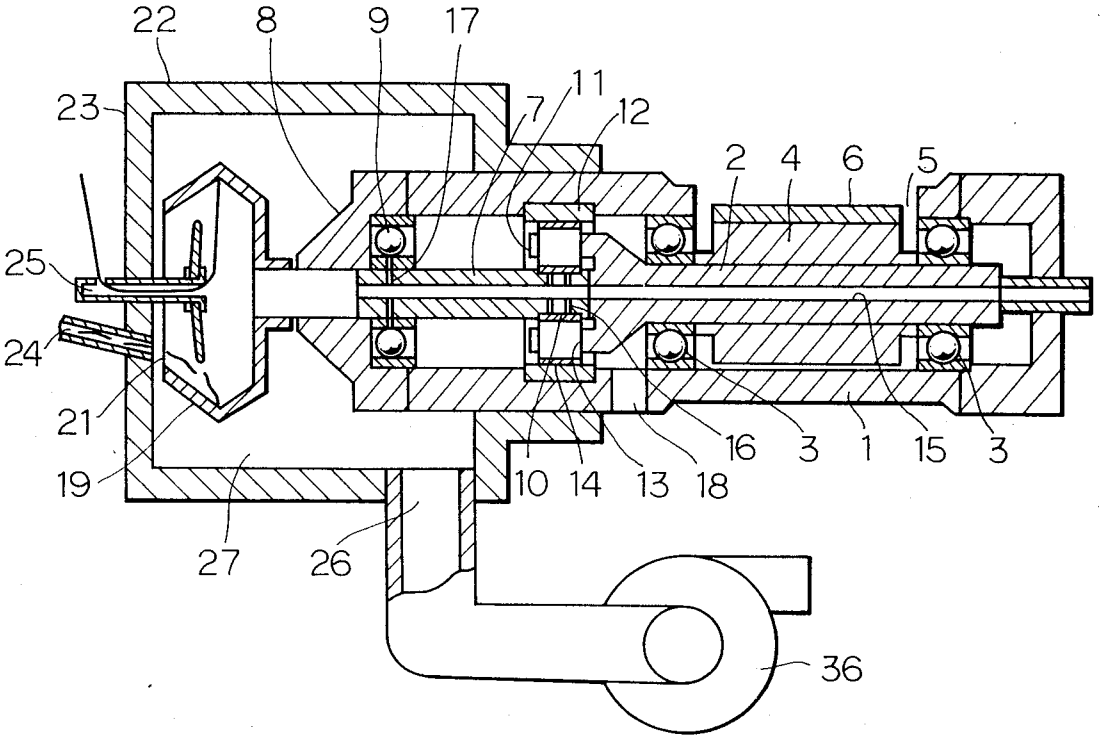
FIG. 7 is a longitudinal, section view of part of a rotor type, open end fine spinning machine, showing a driving gear in accordance with a third embodiment of the invention.

In a third embodiment of the driving gear of this invention as shown in FIG. 7, a blower 36 is used to generate an air flow for guiding the fibers through the fiber feed passage 24 and into the spinning rotor 19, before leaving through the air passage 27. The blower 36 is connected to an exhaust port 26 of the air passage 27 in place of providing the air exhaust holes on the spinning rotor 19. Since this embodiment is similar to the first embodiment except for the above-mentioned differences, like parts in FIG. 7 are designated respectively by the same reference numerals as in their first embodiment and the description will be omitted.

In the rotor type, open end fine spinning machine with driving gear according to this embodiment, the air exhaust holes are not provided through the spinning rotor 19. As a result, the rotation load imposed on the spinning rotor 19 is significantly reduced and, therefore, the rotational speed of the spinning rotor 19 can be further increased.

We claim:

1. A rotational driving mechanism for a yarn spinning machine, said rotational driving mechanism comprising:
   (a) a rotor comprising a cavity therein and an opening in communication with said cavity to permit fiber to be introduced therethrough into said cavity and mounted to be rotated for forming the fibers into a fiber bundle due to the rotation of said rotor;
   (b) means disposed towards said opening for forming a first passage to feed fiber into said chamber;
   (c) means disposed towards said opening for forming a second passage to extract yarn from said fiber bundle within said cavity;
   (d) a rotation shaft coupled to rotate said rotor;
   (e) a drive shaft driven at a first relatively low rotational speed;
   (f) speed multiplying means interposed between said rotation shaft and said drive shaft for rotating said rotor at a second, relatively high speed;
   (g) a cover disposed about said rotor and said rotational shaft, and having an exhaust port; and
   (h) means for providing an air flow along a path within said cover to be exhausted through said exhaust port, whereby the fiber is transported through said first passage and into said chamber, said air flow directed about said rotational shaft to eliminate the friction heat caused by the rotation of said rotor.

2. The rotational driving mechanism as claimed in claim 1, wherein said speed multiplying means comprises a planetary friction wheel mechanism.

3. The rotational driving mechanism as claimed in claim 1, wherein said cover comprises a material having high thermal conductivity and heat radiation.

4. The rotational driving mechanism as claimed in claim 1, wherein there is included a plurality of fins extending into said air passage to facilitate dissipation of the friction heat.

5. The rotational driving mechanism as claimed in claim 1, wherein said air flow providing means comprises a plurality of openings in said rotor for establishing said air flow through said openings, along said passage to be exited through said exhaust port.

6. The rotational driving mechanism as claimed in claim 1, wherein air flow providing means comprises blower means coupled to said exhaust port for establishing reduced pressure within said cover, whereby said air flow is established along said air path within said cover.

* * * * *